United States Patent [19]

Fairman

[11] 4,107,942

[45] Aug. 22, 1978

[54] COOLING SYSTEM

[76] Inventor: Stanley W. Fairman, 8780 E. McKellips Rd., #111, Scottsdale, Ariz. 85257

[21] Appl. No.: 783,107

[22] Filed: Mar. 31, 1977

[51] Int. Cl.[2] ..... F28D 5/00

[52] U.S. Cl. ..... 62/305; 62/310

[58] Field of Search ..... 62/305, 310, 428, 332, 62/333; 261/140 R

[56] References Cited

U.S. PATENT DOCUMENTS

| | | | |
|---|---|---|---|
| 2,030,032 | 2/1936 | Keyes | 62/305 |
| 2,166,158 | 7/1939 | Kalischer | 62/305 |
| 2,323,511 | 7/1943 | Baker | 62/305 |
| 2,620,635 | 12/1952 | Mautner et al. | 62/305 |
| 2,672,024 | 3/1954 | McGrath | 62/305 |
| 2,892,324 | 6/1959 | Quick | 62/305 |
| 3,108,451 | 10/1963 | Clifford | 62/305 |
| 3,747,362 | 7/1963 | Mercer | 62/310 |
| 3,984,995 | 10/1976 | Starr et al. | 62/305 |
| 4,069,687 | 1/1978 | Larriva | 62/310 |

*Primary Examiner*—Lloyd L. King
*Attorney, Agent, or Firm*—Charles E. Cates

[57] ABSTRACT

An improved, flexible habitation cooling system combines an evaporative cooler having a cold water circuit communicating with heat exchange means for cooling the interior of the habitation and a compression refrigeration system. In one embodiment means are provided in a cold water circuit for circulating cooled water from the evaporative cooler into a heat exchanging coil in an air plenum and back to the cooler for re-use. The expansion coil of the refrigeration apparatus communicates with the cold water circuit in heat exchange relationship to further cool the cold water before it enters the coil in the air plenum. In an alternative embodiment wherein the expansion coil is disposed in the air plenum, the cold water circuit is also disposed in the air plenum upstream of the expansion coil. Means for selectively operating the evaporative cooler subsystem alone or in combination with the refrigeration subsystem may be provided so that the lower cost evaporative cooler may be used to cool the habitation in moderate weather without increasing the humidity of the habitation, or combined with the refrigeration system in hotter or more humid weather.

9 Claims, 4 Drawing Figures

COOLING SYSTEM

BACKGROUND OF THE INVENTION

1. Field of the Invention

This invention relates to compression refrigeration systems and evaporative coolers for use in human and animal habitations.

2. The Prior Art

Apparatus employing the standard vapor compression system of refrigeration embodied both in package and split systems are widely used throughout the country to heat residential and commercial structures in which man and animals are housed and wherein their possessions are stored. Such structures will hereafter be referred to as habitations.

In the split system the expansion coil and a fan are located in an air plenum inside the habitation and the compressor and condenser are situated somewhere outside. Refrigerant lines communicate between the inside and outside elements. In the package units the entire cycle of compression and expansion functions are in one housing, usually outside the building, with only the duct work going into the habitation.

In certain areas where low relative humidity prevails a relatively inexpensive-to-operate evaporative cooler, which cools by blowing air into the habitation after passing it through a water-saturated pad of excelsior or the like, is used to reduce the inside dry bulb temperature. Although the evaporative cooler is inexpensive to operate compared to compression refrigeration, its moisture laden air increases relative humidity and, therefore, does not create a comfortable environment when the weather is humid. Another disadvantage is that it creates excessive air motion because of the large air volume required. The introduction of humidity into the air requires that the air be circulated once and exhausted. The habitation air cannot be recirculated through the evaporative cooler because low humidity air is required for the evaporative cooling process.

The prior art workers used evaporative cooling as a pre-cooler to blow air directly on the condenser coil to cool it in the hope of enhancing the efficiency of the refrigeration system. The method is to install a cooler pad covering the inlet of the refrigeration case and provide means for trickling water over the pad.

This apparatus is scarcely more efficient than using compression refrigeration apparatus alone. Although merely providing means for cooling the refrigerant after it leaves the expansion coils helps to cool and therefore condense it, the air flow is reduced by the cooler pads. A second or more powerful motor is added to increase the flow and the increased load requires more power, offsetting the savings. In cooler weather the load is still carried even though not needed. Even the most efficient pre-cooler arrangement has no more than 10 percent increase in efficiency claimed for it, and in practice much less is probably realized.

BRIEF SUMMARY OF THE INVENTION

I conceived that a much greater efficiency might be achieved, and the system made more flexible and responsive to changing parameters of temperature and humidity, by using the cooling power of the evaporative cooler water in addition to that of the evaporative cooler air. It is therefore an object of this invention to provide a more flexible and effective combination of a vapor compression refrigeration and evaporative cooling system that will exhibit enhanced efficiency in the system.

I have devised means to utilize both the cooling potential of the air and the water from the evaporative cooler whereby the system's efficiency and flexibility are enhanced. Also it is possible to utilize only the evaporative cooler to meet lower range cooling load requirements, or the evaporative cooling system in combination with compression refrigeration system of less than ordinary tonnage to carry higher cooling loads. Moreover, in my system the humidity is not raised in the habitation.

Briefly, I accomplish the foregoing results by combining a standard vapor compression refrigeration system and the basic elements of an evaporative cooler system with the addition of means for moving the air from the evaporative cooler over the refrigeration condenser and means for transferring heat from the habitation air to the water from the cooler without direct contact between air and water.

In one of the presently preferred embodiments of the invention the heat exchange means is a cooled water circuit that circulates water, cooled by the evaporative cooler, to a water coil in an air plenum communicating with the air circulation system of the habitation, then back to the evaporative cooler for re-use. It may be further cooled by heat exchange with the expansion coil of the refrigeration system before it enters the cold water coil in the habitation.

In another presently preferred embodiment the cool water circuit is introduced into an air plenum serving a habitation just forward of the refrigeration expansion coil of the refrigeration system, thereby cooling the air before it contacts the expansion coil. This saves a major part of the power required by the operation of the compression refrigeration apparatus, but without increasing the humidity at all.

In existing refrigeration systems the efficiency of the system can be appreciably enhanced by adding the evaporative cooling apparatus and the cold water circuit. In that case the alternative embodiment that places the cold water coil in the air plenum ahead of the expansion coil may be conveniently used.

Using cool air from the evaporative cooler (instead of hot outdoor air) for cooling the condenser, temperature and pressure are both reduced, and less power is required to compress the refrigerant, thus making it possible to use smaller compressor units to do the same job. Experimentally, I have realized savings in power of up to 40 percent by converting an existing home unit. Further efficiency can be achieved by rematching components of the refrigeration system. In this respect, the mathematical relationships of the refrigeration components are known to persons ordinarily skilled in the art; therefore the rematching, which will be performed on an ad hoc basis in view of the teachings of this invention, need not be discussed in detail in this disclosure.

DETAILED DESCRIPTION OF THE PREFERRED EMBODIMENTS

Turning now to the drawings in which the presently preferred embodiments of the invention are described:

Figure 1:
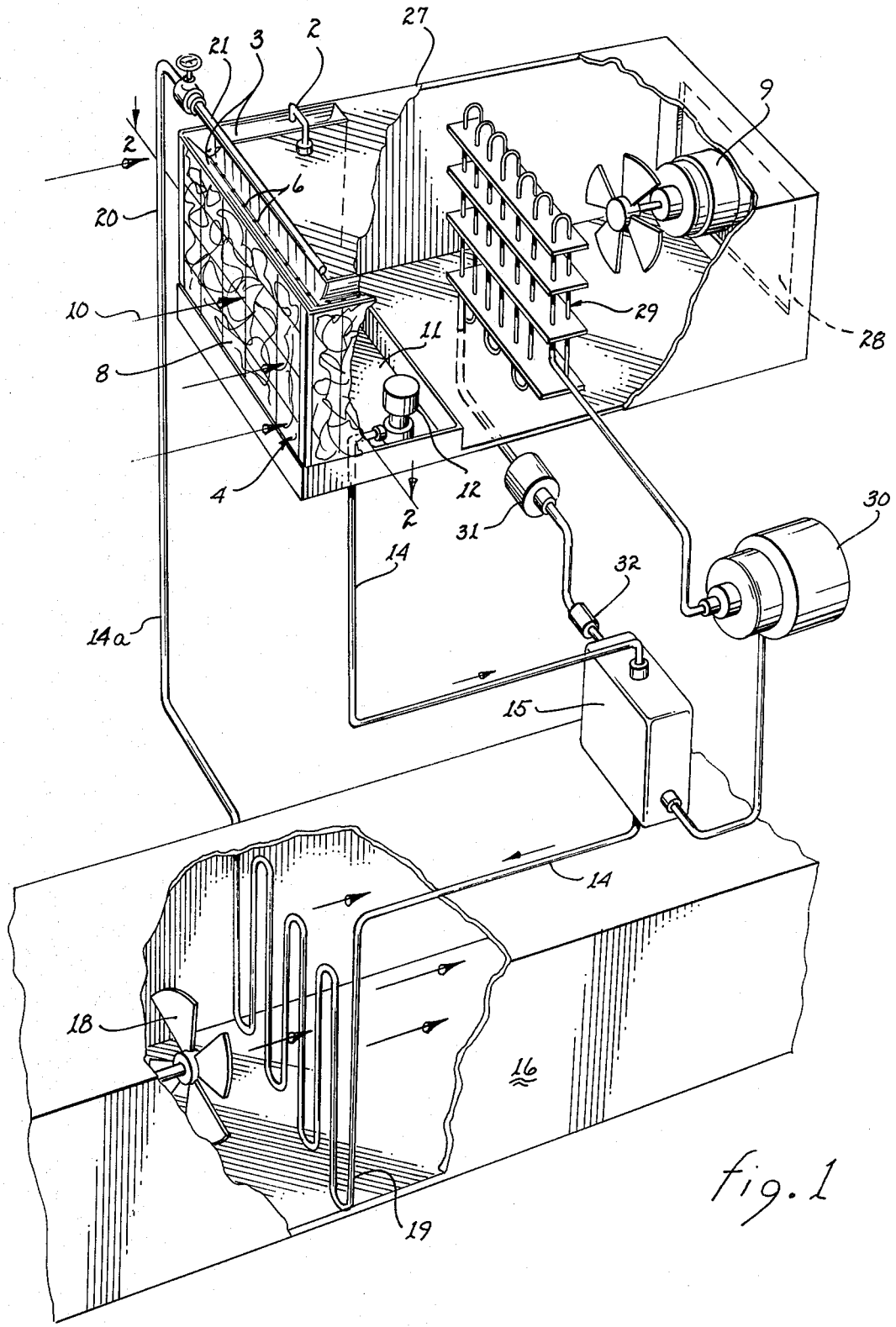
FIG. 1 is a schematic representation of the first presently preferred embodiment of the habitation cooling system with certain elements shown in perspective.
Figure 2:
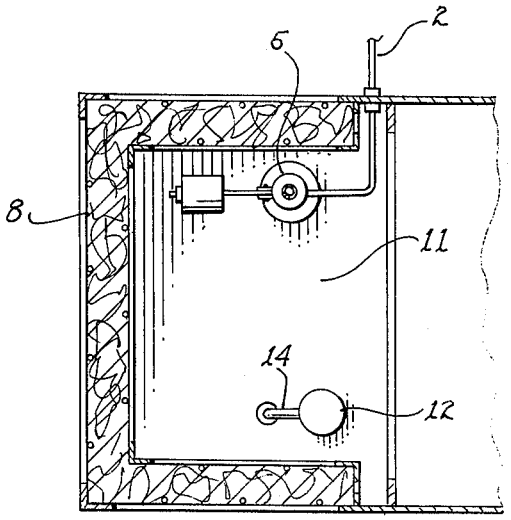
FIG. 2 is a cross section of the chamber shown in FIG. 1 taken along the lines 2—2.

Referring to FIG. 1, wherein the first presently preferred embodiment is illustrated, the habitation cooling system comprises two principal subsystems. The elements of the first, which may be termed the evaporative cooling system, can be traced through its operation as follows. Make up water is brought into the system from a source of supply through water pipe 2 which discharges into the trough 3 of a cooler pad assembly 4. Movement of water through the water pipe 2 is controlled by float valve 5 (FIG. 2) responsive to the water level in sump 11. From the trough 3 the water trickles through apertures 6 in the bottom of the trough over a pad 8 of loose air porous material such as excelsior or the like which serves to expose a large surface area of the water to air drawn through the pad 8 by the action of air fan 9 in the direction of arrows 10.

The pad 8 is disposed to cover the inlet of the chamber 27 such that the air must be drawn through the pad and the air is discharged through the outlet 28 at the opposite end of the box. The area of pad 8 is larger than (conveniently about twice) the area of the condenser coil 29 to provide for adequate air and water volumes and without excessive increase of air resistance for fan 9.

Both water and air are cooled by the passage of the air through the pad as a consequence of heat absorbed by evaporation of a portion of the water. The cooled water collects in sump 11 from whence it is conducted by pump 12 into cooled water line 14 which passes through heat exchanger 15.

The water continues through cooled water line 14 in the direction of the arrow to a point where it enters an air plenum 16 which serves a habitation (not shown) to be cooled. Preferably the air plenum is located inside the habitation in which case the cooled water line 14 is introduced into the habitation. As an alternative, the air plenum may be in part disposed outside the habitation. In either event it is necessary that the plenum be so ducted that recirculation of a substantial quantity of the total habitation air is effected by the habitation air fan 18 which moves the air across the cooled water coils 19. One of the advantages of refrigeration cooling and my improvement is that it is not necessary to exhaust the total air to keep humidity from rising to intolerable levels. After the heat exchange the water is returned by line 14*a* to water manifold 21 which distributes the now warmed water into the trough 3 of the cooler pad assembly 4 and the entire cycle is repeated.

On moderately warm days, when the humidity is relatively low, the cooling of the water in the evaporative cooling system and its use in the cooled water circuit may be sufficient to cool the habitation air to the temperature desired without the need of refrigeration. On such days not much if any saving of power is realized in operating only the evaporative cooler subsystem compared to operating the entire system of the invention, but a number of other advantages result. There is less wear and tear on the more expensive refrigeration compressor, for one thing. For another, comfort is enhanced because the incoming air from the coil is not much colder than the habitation air and the fan operates a greater portion of the time, thus avoiding frequent, intermittent streams of cold air.

On very hot days or days when the combination of temperature and humidity overtaxes the capacity of the evaporative cooling system, the compression refrigeration system, which is the second principal subsystem of the habitation cooling system, is switched in to help carry the cooling load.

The compression refrigeration system functions in the conventional way, except that the expansion coil (not shown) exchanges heat with the cooled water line 14 in the heat exchanger 15. Briefly, tracing the refrigeration cycle, the condenser 29 is cooled by the flow of evaporation-cooled air passing through the chamber 27. The refrigerant liquid, cooled in the condenser 29, is pumped to a receiver 31, thence to an expansion valve 32 and into an expansion coil (not shown) in heat exchanger 15. As the refrigerant gas expands it absorbs heat from the cooled water line 14 which also passes through the heat exchanger. Then the refrigerant is returned to the compressor 30 which compresses the refrigerant and sends it to the condenser to continue to cycle.

Figure 3:
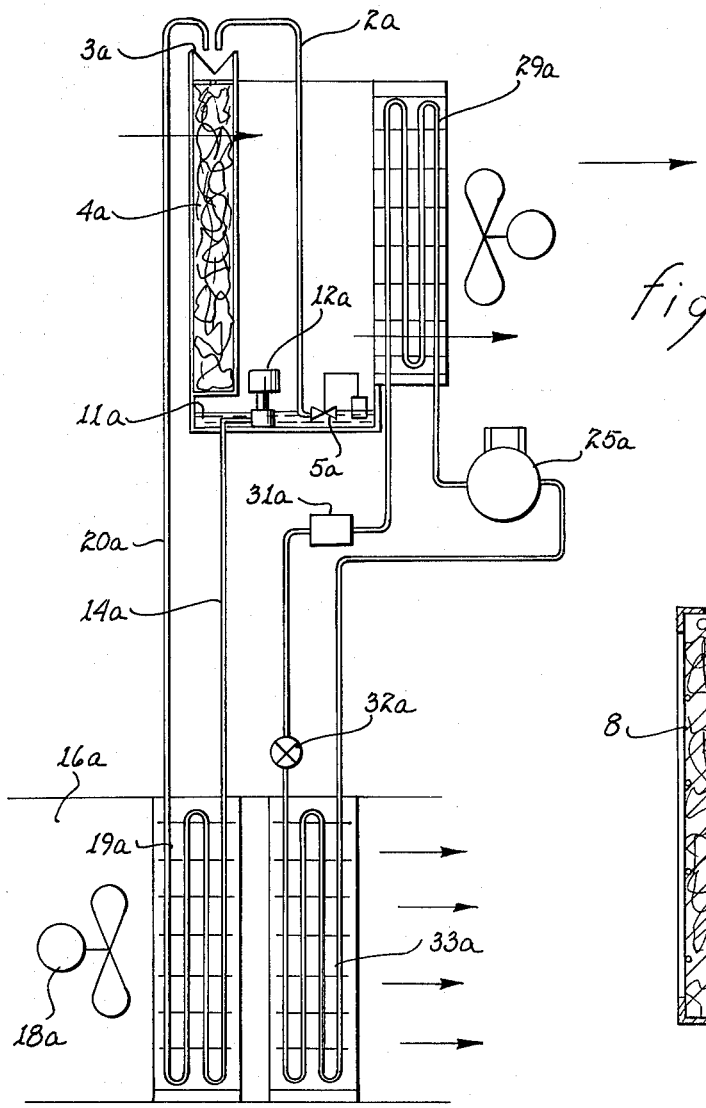
FIG. 3 is a schematic representation of a second presently preferred embodiment of the habitation cooling system.

Turning now to FIG. 3, there is illustrated an alternative preferred embodiment which is particularly well suited to the adaptation of an already installed compression refrigeration system to the practice of this invention. The chamber which encloses the cooler pad assembly and condenser is omitted for convenience in presentation. As in the first embodiment the cycle is commenced by the introduction of water through pipe 2*a* to trough 3*a* of the cooler pad assembly 4*a*.

The flow of makeup water through pipe 2*a* is controlled by a float valve 5*a*. As in the apparatus of FIG. 1 the cooler pad assembly is disposed to cover the inlet of the chamber such that the air must be drawn through the pads and not around it. To provide optimum cooling capacity the cross section area of the inlet is made large enough to avoid restricting the flow of air through the chamber.

The water trickles through the pad and is collected in sump 11*a* from which it is transported by the action of the pump 12*a* through cooled water line 14*a* into the air plenum 16*a* where the coils 19*a* of the cold water line absorb heat from the habitation air. The latter is moved through the plenum 16*a* by habitation air fan 18*a*. After the heat exchange the now warmed water is transported through water return line 20*a* to repeat the cycle.

The condenser 29*a* shares the chamber with the cooler pad assembly 4*a*. The refrigerant gas is cooled and condensed by the air cooled by evaporation in the cooler pad assembly 4*a*. The condensed liquid is pumped to the receiver 31*a*, thence to expansion valve 32*a*, and to the expansion coil 33*a*. It is thereafter sent back into the compressor 25*a* to repeat the cycle.

In this second embodiment the option of using the evaporative cooling system element alone still obtains. The cooling capacity of the refrigeration system is added in hot, humid weather by heat exchange of the expansion coil with the inside habitation air after the latter has been cooled to an extent by the water coil 19*a*.

As in the first embodiment the air plenum may be inside the habitation or merely ducted into the habitation.

Figure 4:
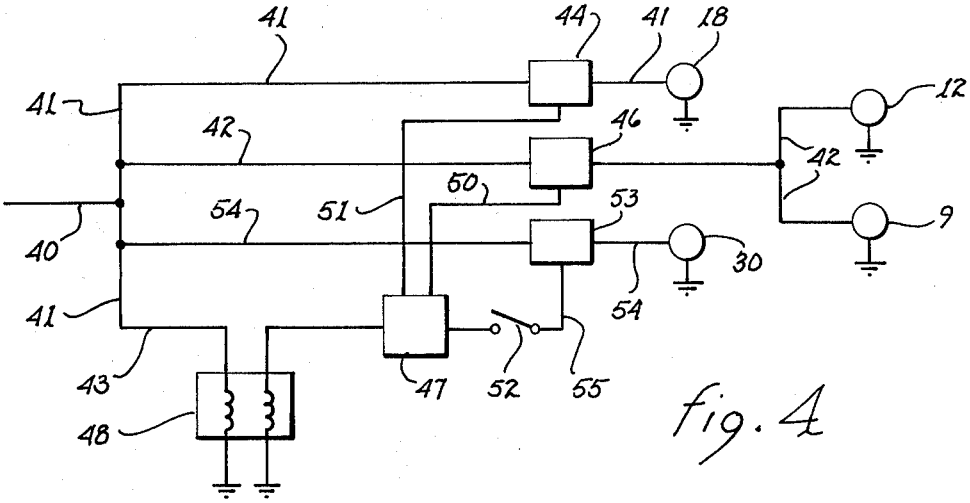
FIG. 4 is a greatly simplified schematic representation of the electrical control system associated with the systems shown in FIGS. 1 and 2.

FIG. 4 illustrates in simplified schematic form a modification of an electrical circuit of a refrigeration system to incorporate the evaporative cooling pump motor and a switch to selectively disengage the compressor. Although the circuit is depicted in a one phase convention for convenience, a three phase system may also be used.

Line voltage is brought in on electrical circuit 40 and is conducted through branch circuits 41, 42, 54 and 43. Circuit 41 serves the habitation air fan 18 controlled by relay switch 44. Branch circuits 42 and 54 serve the water pump 12, the outside air fan 9 and compressor 30 which are controlled by relays 46 and 53. Circuit 43 serves a transformer 48 where the voltage is stepped down for use to serve thermostat 47. The latter, in response to temperature changes, opens and closes circuits 50 and 51 to operate relays 44 and 46 controlling circuits 41 and 42.

A manually operated switch 52 is provided in line 55 to control the relay 53 so that it may be selectively used to de-energize the compressor 30 when desired to use only the evaporative cooling subsystem. The switch 52 is located near the thermostat 47 as a matter of convenience; alternatively it may be disposed in other locations or even connected to suitable relays controlled by remote temperature and humidity sensing devices to automatically activate or deactivate the compressor in response to environmental conditions.

Whereas, I have described preferred embodiments of this invention it is to be understood that the invention is not limited thereto and may be otherwise embodied within the scope of the appended claims.

What is claimed is:

1. A habitation cooling system comprising the combination of a compression refrigeration system; an evaporative cooler, having means for evaporating water by contact with moving air whereby said air and water are cooled; means for moving air cooled by said evaporative cooler over the condenser of said refrigeration system; means for transferring heat from the air in the habitation to the cooled water without bringing the air and the water into direct contact.

2. The system of claim 1 with the addition of heat exchange means for transferring additional heat from the cooled water to the evaporation coil of said refrigeration system before heat from the air is transferred to the cooled water.

3. The system of claim 1 wherein the means for transferring heat from the habitation air to the cooled water comprises an air plenum, means for circulating habitation air through said plenum, and a cooled water circuit communicating with said evaporative cooler and said plenum, said circuit having a heat exchange coil disposed in said plenum.

4. The system of claim 3 wherein said cooled water circuit returns the water to said evaporative cooler for re-use therein.

5. The cooling system of claim 3 wherein the expansion coil of said refrigeration system is disposed in said air plenum downstream from said cooled water circuit coil.

6. The cooling system of claim 1 wherein said air plenum is wholly disposed within the habitation.

7. The habitation cooling system of claim 1 with the addition of means for making up water lost by evaporation in said cooler.

8. The habitation cooling system of claim 1 with the addition of means for selectively operating the whole system or only the evaporative cooler subsystem.

9. The habitation cooling system of claim 1 wherein one motorized fan provides means to move the air of the evaporative cooler over the condenser of said refrigeration system in heat exchange relationship.

* * * * *